US010795289B2

(12) United States Patent
Hasegawa et al.

(10) Patent No.: US 10,795,289 B2
(45) Date of Patent: Oct. 6, 2020

(54) FIXING DEVICE AND IMAGE FORMING APPARATUS INCORPORATING THE SAME

(71) Applicants: Kenichi Hasegawa, Kanagawa (JP); Kenji Ishii, Kanagawa (JP)

(72) Inventors: Kenichi Hasegawa, Kanagawa (JP); Kenji Ishii, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/550,028

(22) Filed: Aug. 23, 2019

(65) Prior Publication Data

US 2020/0089147 A1 Mar. 19, 2020

(30) Foreign Application Priority Data

Sep. 18, 2018 (JP) ..... 2018-173735

(51) Int. Cl.
*G03G 15/20* (2006.01)

(52) U.S. Cl.
CPC ..... *G03G 15/2025* (2013.01); *G03G 15/2064* (2013.01); *G03G 2215/2032* (2013.01); *G03G 2215/2093* (2013.01)

(58) Field of Classification Search
CPC ..... G03G 15/2025
See application file for complete search history.

(56) References Cited

U.S. PATENT DOCUMENTS 5,091,752 A * 2/1992 Okada ..... G03G 15/2064 399/329
5,576,821 A * 11/1996 Rasch ..... G03G 15/2025 399/325
7,158,747 B2 * 1/2007 Oonishi ..... G03G 15/206 399/329
8,032,068 B2 * 10/2011 Hanyu ..... G03G 15/2064 399/328
8,346,146 B2 * 1/2013 Yamada ..... G03G 15/2064 399/329
8,693,933 B2 * 4/2014 Tsukioka ..... G03G 15/2053 399/329

(Continued)

FOREIGN PATENT DOCUMENTS

JP 52026836 A * 2/1977
JP 05019650 A * 1/1993

(Continued)

OTHER PUBLICATIONS

European search report; Application 19193350.6; dated May 6, 2020.

*Primary Examiner* — Walter L Lindsay, Jr.
*Assistant Examiner* — Milton Gonzalez
(74) *Attorney, Agent, or Firm* — Duft & Bornsen, PC

(57) ABSTRACT

A fixing device includes a stationary member, a roller, an endless belt, a pressure rotator, and a lubricant applicator. The endless belt is stretched over the stationary member and the roller. The pressure rotator is disposed opposite the stationary member via the endless belt to form a fixing nip between the pressure rotator and the endless belt on the stationary member. The lubricant applicator contacts the roller over an entire length of the roller in an axial direction of the roller. The lubricant applicator contacts an inner surface of the endless belt and has an axial length equal to or greater than an axial length of the stationary member.

9 Claims, 7 Drawing Sheets

(56) References Cited

U.S. PATENT DOCUMENTS

| | | | | |
|---|---|---|---|---|
| 2010/0189477 | A1 | 7/2010 | Yamada | |
| 2012/0027478 | A1 | 2/2012 | Tsukioka | |
| 2013/0272758 | A1* | 10/2013 | Hayashi ..... | G03G 15/2053 399/329 |
| 2014/0119787 | A1 | 5/2014 | Hasegawa | |
| 2017/0255147 | A1 | 9/2017 | Seki et al. | |
| 2017/0261900 | A1 | 9/2017 | Sawada et al. | |
| 2017/0343942 | A1 | 11/2017 | Okamoto et al. | |
| 2017/0364000 | A1 | 12/2017 | Seki et al. | |
| 2018/0011432 | A1 | 1/2018 | Yoshinaga et al. | |
| 2018/0017910 | A1 | 1/2018 | Sawada et al. | |
| 2018/0059587 | A1 | 3/2018 | Sawada et al. | |
| 2018/0059598 | A1 | 3/2018 | Hasegawa et al. | |
| 2018/0120741 | A1 | 5/2018 | Yoshinaga et al. | |
| 2018/0157198 | A1 | 6/2018 | Seto et al. | |
| 2018/0173138 | A1 | 6/2018 | Seki et al. | |
| 2018/0284669 | A1 | 10/2018 | Fujimoto et al. | |
| 2018/0335733 | A1 | 11/2018 | Matsuda et al. | |
| 2018/0348680 | A1 | 12/2018 | Fujimoto et al. | |
| 2018/0356754 | A1 | 12/2018 | Yoshinaga et al. | |

FOREIGN PATENT DOCUMENTS

| | | | |
|---|---|---|---|
| JP | 11-045018 | | 2/1999 |
| JP | 2007279386 | A | 10/2007 |
| JP | 2009-116141 | | 5/2009 |
| JP | 2011-017882 | | 1/2011 |
| JP | 2011-017973 | | 1/2011 |
| JP | 2011-043735 | | 3/2011 |
| JP | 2014-089234 | | 5/2014 |
| JP | 2017-003606 | | 1/2017 |

* cited by examiner

FIXING DEVICE AND IMAGE FORMING APPARATUS INCORPORATING THE SAME

CROSS-REFERENCE TO RELATED APPLICATION

This patent application is based on and claims priority pursuant to 35 U.S.C. § 119 to Japanese Patent Application No. 2018-173735, filed on Sep. 18, 2018 in the Japanese Patent Office, the entire disclosure of which is hereby incorporated by reference herein.

BACKGROUND

Technical Field

Embodiments of the present disclosure generally relate to a fixing device and an image forming apparatus incorporating the fixing device.

Background Art

Image forming apparatuses use various types of fixing devices, one of which has a fixing nip formed between an endless rotating belt and a pressure roller. The fixing device includes a stationary member opposite the pressure roller inside a loop of the fixing belt to support the inner circumferential surface of the fixing belt. Since the stationary member contacts the inner circumferential surface of the fixing belt that slides along the stationary member, a lubricant such as oil and grease is applied to the inner circumferential surface of the fixing belt to decrease sliding friction between the stationary member and the fixing belt.

SUMMARY

This specification describes an improved fixing device that includes a stationary member, a roller, an endless belt stretched over the stationary member and the roller, a pressure rotator disposed opposite the stationary member via the endless belt to form a fixing nip between the pressure rotator and the endless belt on the stationary member, and a lubricant applicator contacting the roller over the entire length of the roller in an axial direction of the roller that contacts an inner surface of the endless belt and has an axial length equal to or greater than an axial length of the stationary member.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
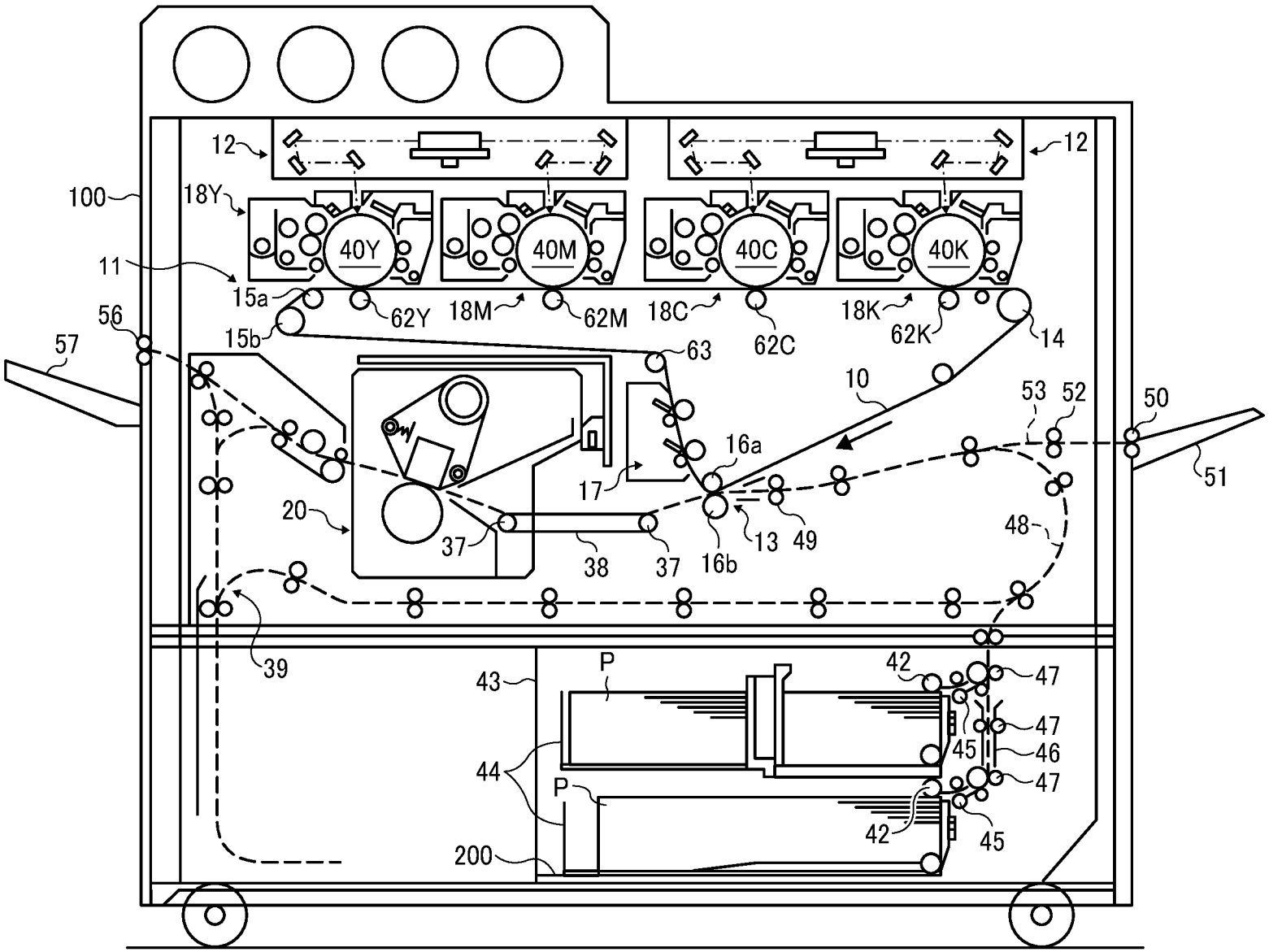
FIG. 1 is a schematic diagram illustrating a configuration of an image forming apparatus using a fixing device according to embodiments of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings illustrating the following embodiments, the same reference numbers are allocated to elements having the same function or shape and redundant descriptions thereof are omitted below.

With reference to FIG. 1, a description is provided of a construction of the image forming apparatus 100. FIG. 1 is a schematic diagram illustrating a configuration of the image forming apparatus 100 using a fixing device according to an embodiment of the present disclosure.

The image forming apparatus 100 is an apparatus for forming an image using toner, such as a printer, a copier, and a fax machine, and includes a fixing device for fixing a toner image (unfixed image) formed on a sheet-like recording medium. The image forming apparatus 100 of the present embodiment employs a tandem intermediate transfer system and includes the fixing device 20 according to the embodiment of the present disclosure and a sheet feeding table 200 having a sheet feeding tray 44 in a lower part of the image forming apparatus 100.

In the following description, the term "image forming apparatus" refers to an image forming apparatus that performs image formation by attaching developer or ink to a medium such as paper, an overhead projector (OHP) transparency, yarn, fiber, cloth, leather, metal, plastic, glass, wood, ceramics and the like. The term "image formation" indicates an action for providing (i.e., printing) not only an image having a meaning, such as texts and figures on a recording medium, but also an image having no meaning, such as patterns on a recording medium.

The term "sheet-like body" includes not only paper but also any material called recording medium, recording paper, or a recording sheet, such as an overhead projector (OHP) transparency sheet, textile, and the like, to which toner or ink adheres. In the following embodiments, the "sheet-like body" indicates a sheet, and size (dimension), material, shape, and relative positions used to describe each of the components and units are examples, and the scope of this disclosure is not limited thereto unless otherwise specified.

The image forming apparatus 100 includes inside a tandem image forming section 11 employing the tandem intermediate transfer system. The tandem image forming section 11 includes a plurality of image forming devices 18Y, 18M, 18C, and 18K aligned horizontally. Suffixes Y, M, C, and K represent yellow, magenta, cyan, and black toner, respectively.

The image forming apparatus 100 includes an endless belt-shaped intermediate transferor, hereinafter called an intermediate transfer belt 10, situated in a substantially center portion of the image forming apparatus 100. The intermediate transfer belt 10 is entrained around and supported by a plurality of support rollers 14, 15*a*, 15*b*, 16*a*, and the like. The intermediate transfer belt 10 is rotatable in a clockwise direction in FIG. 1.

In a configuration illustrated in FIG. 1, the image forming apparatus 100 includes a belt cleaner 17 disposed downstream from one of the support rollers that is a secondary transfer backup roller 16*a* in a direction of rotation of the intermediate transfer belt 10 to clean the intermediate transfer belt 10. The belt cleaner 17 removes residual toner remaining on the intermediate transfer belt 10 after an image formed on the intermediate transfer belt 10 is transferred.

Above the intermediate transfer belt 10 stretched taut between the support rollers 14 and 15*a*, the image forming apparatus 100 includes the four image forming devices 18Y, 18M, 18C, and 18K aligned in the direction of rotation of the intermediate transfer belt 10, which form yellow (Y), magenta (M), cyan (C), and black (K) images, respectively.

As described above, the four image forming devices 18Y, 18M, 18C, and 18K aligned laterally constitute the tandem image forming section 11. The image forming devices 18Y, 18M, 18C, and 18K of the tandem image forming section 11 each include photoconductor drums 40Y, 40M, 40C, and 40K as image bearers to bear toner images of yellow, magenta, cyan, and black.

Above the tandem image forming section 11, the image forming apparatus 100 includes two exposure devices 12. The left exposure device 12 is disposed opposite the two image forming devices 18Y and 18M. The right exposure device 12 is disposed opposite the two image forming devices 18C and 18K. Each of the exposure devices 12 employs an optical scanning system and includes a light source device such as a semiconductor laser, a semiconductor laser array, and a multi-beam light source, a coupling optical system, a common light deflector such as a polygon mirror, and a dual-system scanning image forming optical system.

The exposure devices 12 expose the photoconductor drums 40Y, 40M, 40C, and 40K according to yellow, magenta, cyan, and black image data, forming electrostatic latent images on the photoconductor drums 40Y, 40M, 40C, and 40K, respectively. A charger, a developing device, and a photoconductor cleaner are provided adjacent each of the photoconductor drums 40Y, 40M, 40C, and 40K in each of the image forming devices 18Y, 18M, 18C, and 18K. The charger uniformly charges the photoconductor drum prior to exposure. The developing device develops an electrostatic latent image formed by exposure with each of yellow, magenta, cyan, and black toner. The photoconductor cleaner removes residual toner remaining on the photoconductor drum.

In addition, the image forming apparatus 100 includes primary transfer rollers 62Y, 62M, 62C, and 62K at primary transfer positions to transfer a toner image from each of the photoconductor drums 40Y, 40M, 40C, and 40K onto the intermediate transfer belt 10. The primary transfer rollers 62Y, 62M, 62C, and 62K are opposite the photoconductor drums 40Y, 40M, 40C, and 40K with the intermediate transfer belt 10 sandwiched between the primary transfer rollers 62Y, 62M, 62C, and 62K and the photoconductor drums 40Y, 40M, 40C, and 40K, respectively and function as primary transferors.

Among the plurality of support rollers 14, 15*a*, 15*b*, and 16*a* that support the intermediate transfer belt 10, the support roller 14 is a drive roller that drives and rotates the intermediate transfer belt 10. The support roller 14 is coupled to a motor through a driving force transmitter such as a gear, a pulley, and a belt. When the image forming apparatus 100 forms a black monochrome image on the intermediate transfer belt 10, a transfer mechanism moves the support rollers 15*a* and 15*b* other than the support roller 14 to separate the intermediate transfer belt 10 from the photoconductor drums 40Y, 40M, and 40C. In addition to the plurality of support rollers 14, 15*a*, 15*b*, and 16*a*, a backup roller 63 is disposed to support the intermediate transfer belt 10 from outside the loop formed by the intermediate transfer belt 10.

A secondary transfer device 13 is disposed opposite the tandem image forming section 11 via the intermediate transfer belt 10. In the secondary transfer device 13, a secondary transfer roller 16*b* is pressed against the secondary transfer backup roller 16*a* via the intermediate transfer belt 10 and is applied a transfer electrical field to transfer the toner image from the intermediate transfer belt 10 onto the sheet P.

Downstream from the secondary transfer device 13 in a direction of conveyance of the sheet P, the fixing device 20 is disposed to fix the toner image transferred onto the sheet P. A conveyance belt 38 supported by two conveyance rollers 37 conveys the sheet P onto which the toner image is transferred in the secondary transfer device 13 to the fixing device 20. Instead of the conveyance belt 38, a stationary guide, a conveyance roller, or the like may be used. The image forming apparatus 100 includes a sheet reverse device 39 below the tandem image forming section 11, the secondary transfer device 13 and the fixing device 20 to reverse and convey the sheet P and print another toner image on a back side of the sheet P.

To provide a fuller understanding of the embodiments of the present disclosure, a description is now given of an image forming operation together with conveyance of the sheet P in the image forming apparatus 100, with continued reference to FIG. 1.

Initially, one of sheet feeding rollers 42 in the sheet feeding table 200 is selected and rotated to pick up and feed the sheets P from one of the plurality of sheet feeding trays 44 layered in a paper bank 43. A separation roller 45 separates the fed sheets P one by one and puts the sheet P in a conveyance passage 46. A sheet feeding conveyance roller pair 47 conveys the sheet along the conveyance passage 46 to a conveyance passage 48 in the image forming apparatus 100, and after that, a leading edge of the sheet P contacts a registration roller pair 49 as a positioning roller pair, which halts the sheet temporarily.

Instead of feeding the sheet P from the sheet feeding table 200, the sheet P may be manually imported into the image forming apparatus 100 by use of a bypass feeder 51, on which a plurality of sheets is placed. A sheet feeding roller 50 is rotated to pick up the sheets from the bypass feeder 51 and send the sheets to a separation roller 52. The separation roller 52 separates the sheets and sends the sheet P to a bypass conveyance passage 53 one by one. Like the sheet P conveyed from the sheet feeding table 200, the leading edge of the sheet P conveyed from the bypass feeder 51 contacts the registration roller pair 49 and stops temporarily.

Subsequently, in synchronization with movement of the multicolor toner image formed on the intermediate transfer belt 10, the registration roller pair 49 rotates to send the sheet P to a secondary transfer position between the intermediate transfer belt 10 and the secondary transfer roller 16*b*. Thus, the multicolor toner image formed on the intermediate transfer belt 10 is collectively transferred from the intermediate transfer belt 10 onto the sheet P.

The conveyance belt 38 conveys the sheet P to which the toner image has been transferred to the fixing device 20 according to the present disclosure. Thereafter, the fixing device 20 applies heat and pressure to the toner image on the sheet P to fix the toner image on the sheet P. An ejection roller pair 56 ejects the sheet P having the fixed toner image to an output tray 57, and the sheet P is stacked on the output tray 57.

In duplex printing, after the toner image is fixed on one side of the sheet P, the sheet P is conveyed to a sheet reverse device 39, turned upside down, and conveyed again to the secondary transfer position. At the secondary transfer position, another toner image is transferred onto the back side of the sheet P. The sheet P is then conveyed to the fixing device 20 that fixes another toner image onto the back side of the sheet P. Thereafter, the ejection roller pair 56 ejects the sheet P to the output tray 57.

Figure 2A:
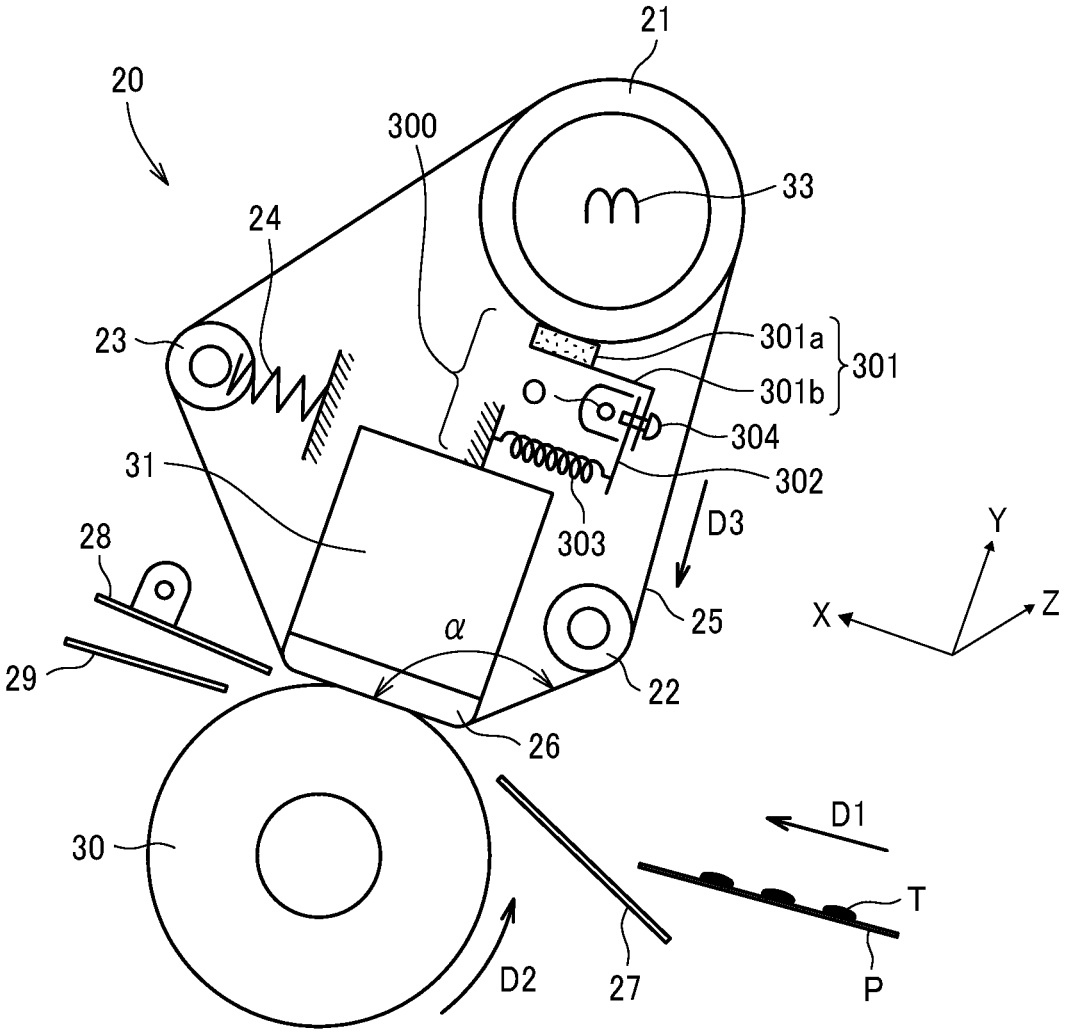
FIG. 2A is a schematic cross-sectional view of a fixing device according to a first embodiment of the present disclosure.
Figure 2B:
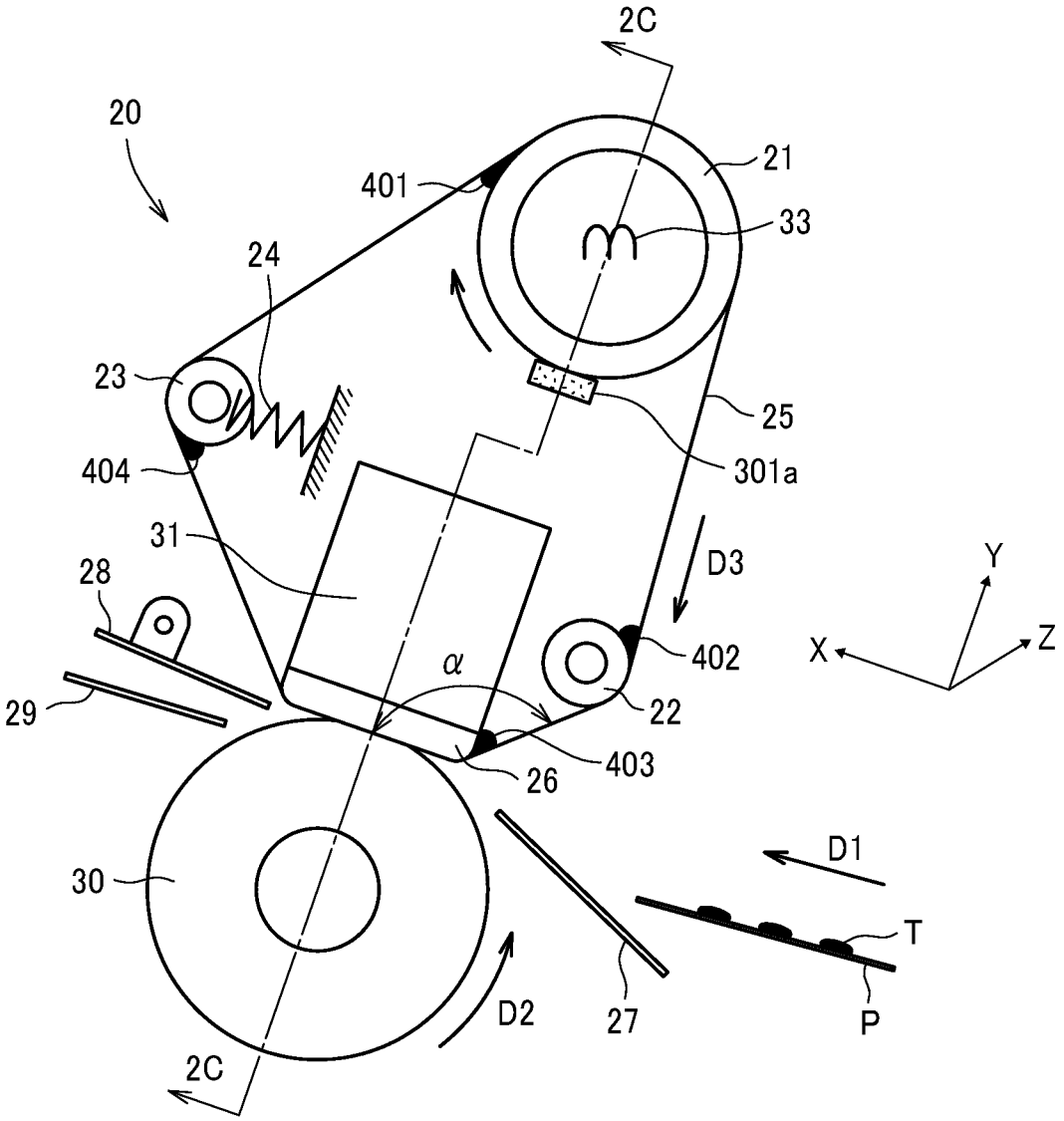
FIG. 2B is a schematic cross-sectional view illustrating oil accumulated in the fixing device according to the first embodiment.
Figure 2C:
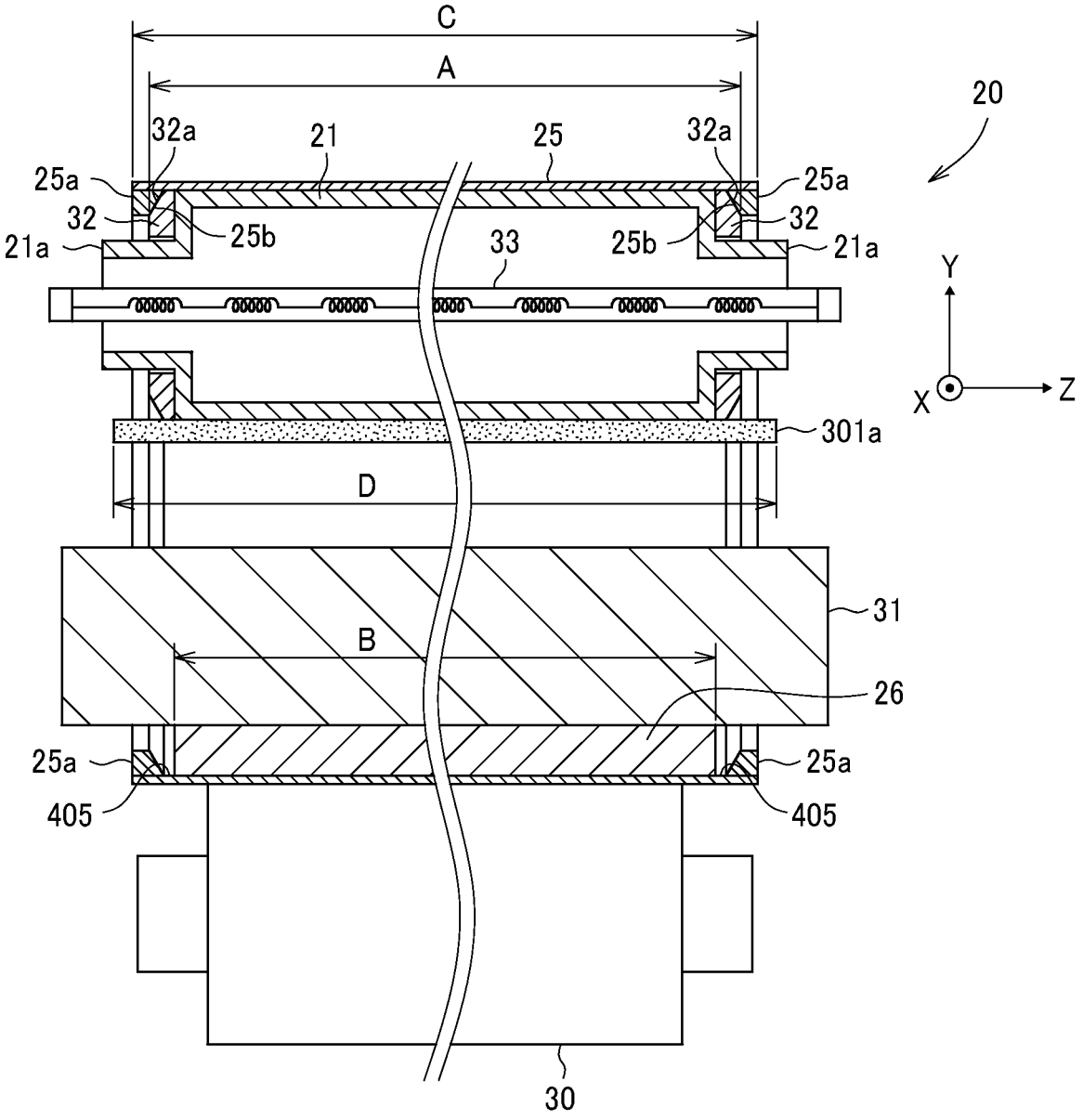
FIG. 2C is a cross-sectional view along arrow 2C-2C of FIG. 2B.
Figure 3:
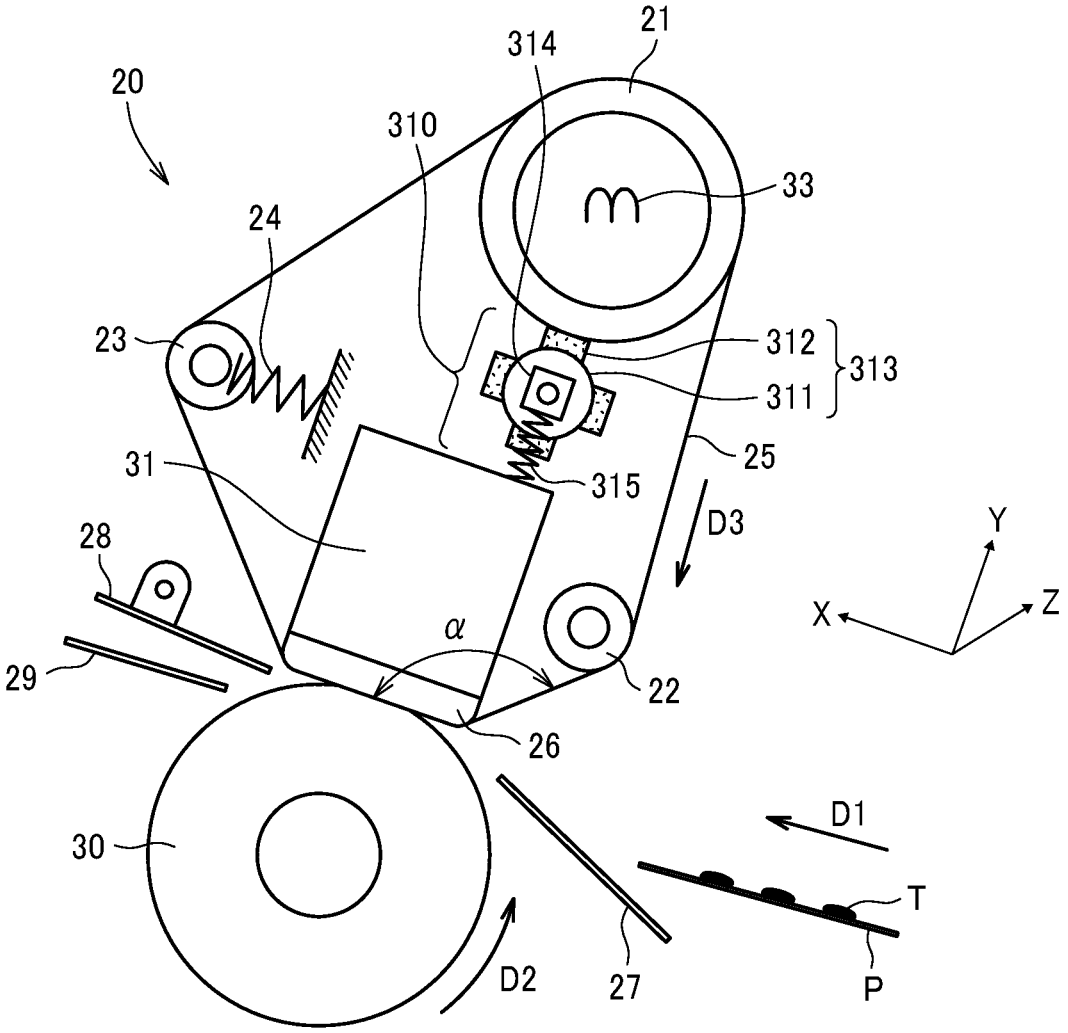
FIG. 3 is a schematic cross-sectional view of a fixing device according to a second embodiment of the present disclosure.
Figure 4A:
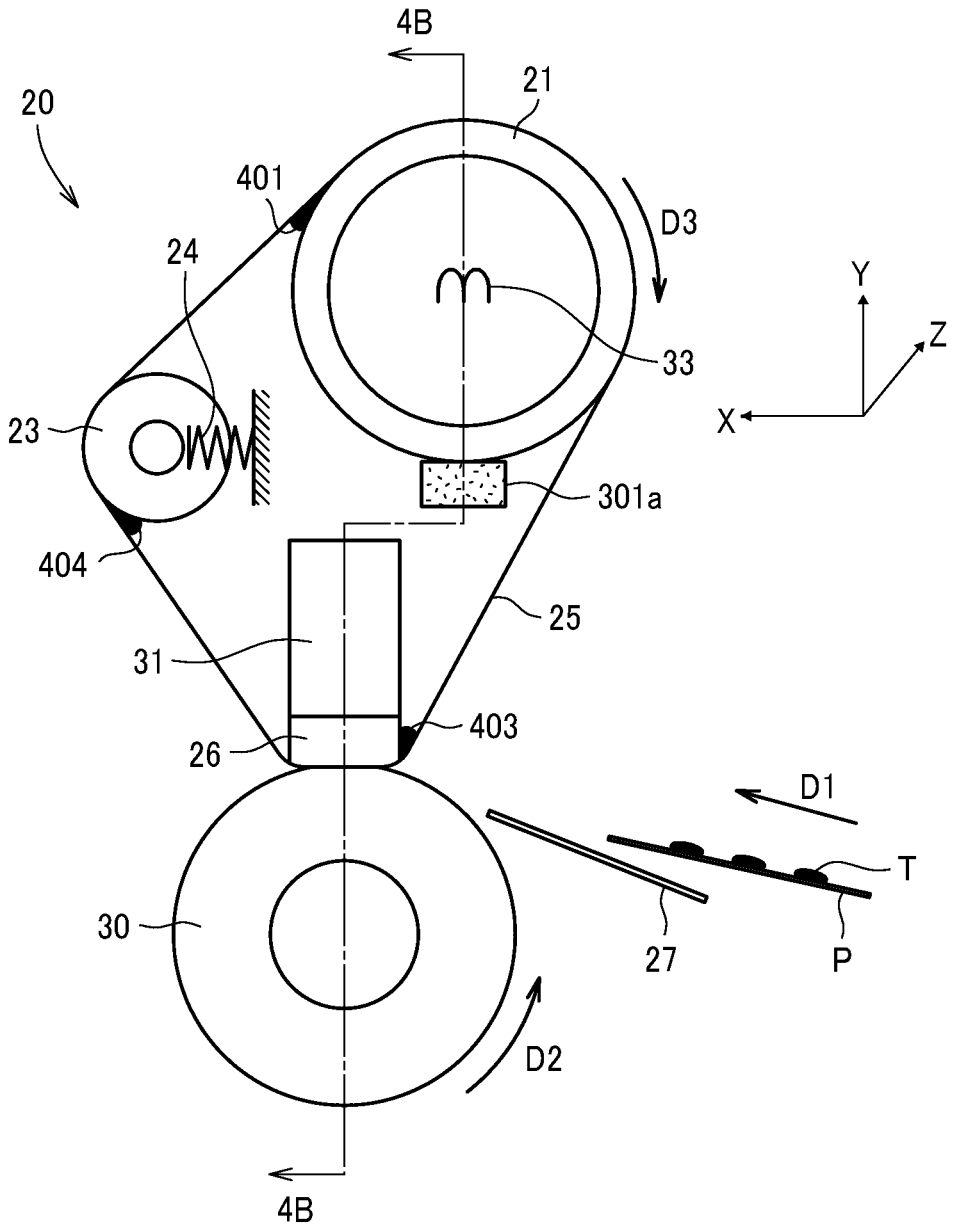
FIG. 4A is a schematic cross-sectional view of a fixing device according to a third embodiment of the present disclosure.
Figure 4B:
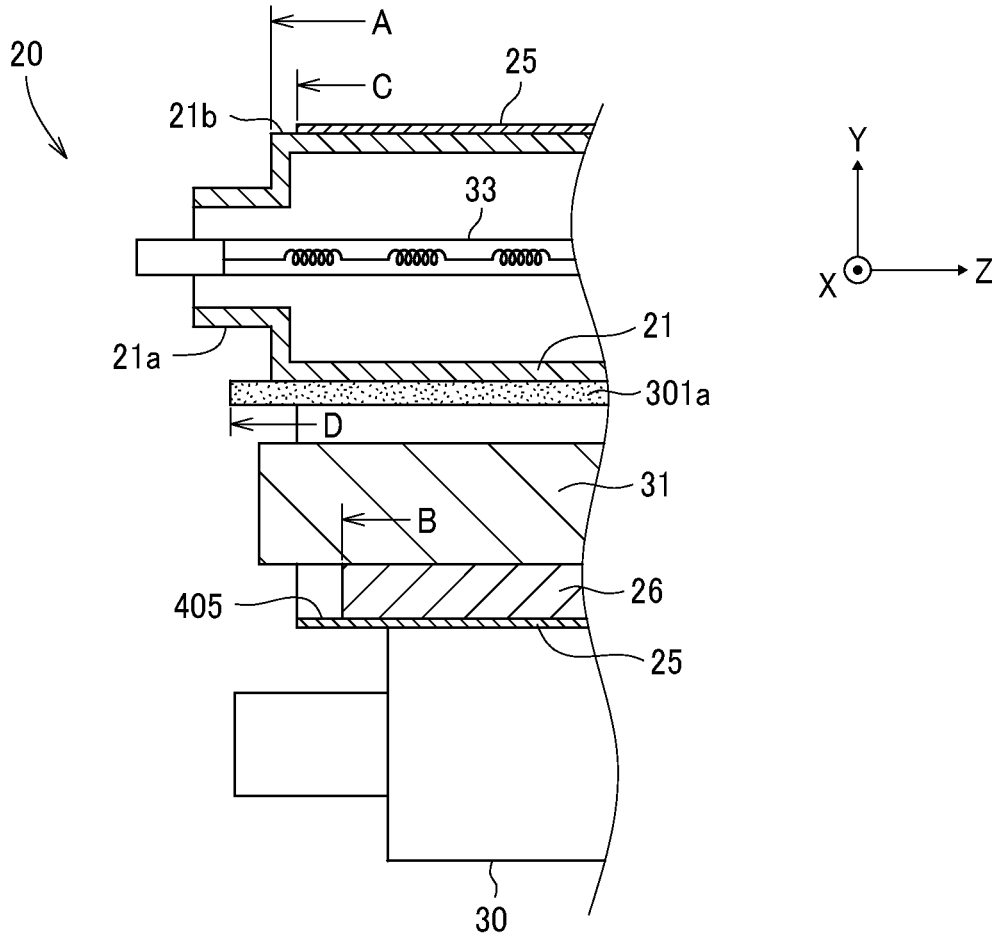
FIG. 4B is a cross-sectional view along arrow 4B-4B of FIG. 4A.

Next, a description is given of the fixing device 20 according to embodiments of the present disclosure, including a first embodiment illustrated in FIGS. 2A to 2C, a second embodiment illustrated in FIG. 3, and a third embodiment illustrated in FIGS. 4A and 4B in this order.

A description is provided of the fixing device 20 according to the first embodiment.

As illustrated in FIGS. 2A to 2C, the fixing device 20 according to the first embodiment includes an endless fixing belt 25 entrained around a plurality of rollers 21, 22, and 23 and the stationary member 26 and a pressure roller 30 as a pressure rotator configured to alternately contact and separate from the fixing belt 25. Note that, alternatively, instead of the pressure roller 30, a pressure belt may be used.

The plurality of rollers 21, 22 and 23 include a fixing roller 21 driven to rotate by a driver and including a heater 33, a tension roller 22, and a pressure adjustment roller 23 which a biasing member 24 presses. A motor as the driver rotate the pressure roller 30, and the rotation of the pressure roller 30 drives the fixing belt 25 to rotate. The pressure roller 30 presses against the stationary member 26 via the fixing belt 25 to form a nip between the stationary member 26 and the pressure roller 30.

In FIGS. 2A to 2C, the pressure roller 30 contacts the fixing belt 25. The pressure roller 30 and the fixing belt 25 that contact each other heat and melt an unfixed toner image T formed on the sheet P at the nip to fix the toner image T on the sheet P.

The sheet P on which the toner image is formed enters the nip from an entrance guide 27 and is ejected to an exit guide 29. A separator 28 is disposed on the fixing belt 25 side downstream from the nip to prevent the sheet P ejected from the nip from being wound around the fixing belt 25.

Next, the stationary member 26 is described. A frame of the fixing device 20 supports a rigid supporter 31 inserted into the loop of the fixing belt 25 to support and fix the stationary member 26. Accordingly, even if the stationary member 26 receives pressure from the pressure roller 30, the stationary member 26 is not displaced and bent but maintains a stable, uniform nip width. Pressure exerted by the pressure roller 30 on the stationary member 26 may be controlled to adjust the nip width.

With reference to FIG. 2C, it is to be noted that a length B of the stationary member 26 in a Z-direction is shorter than a length C of the fixing belt 25 in the Z-direction, that is, B<C. In FIGS. 2A and 2B, the stationary member 26 has a nip formation surface in an X-direction in FIGS. 2A and 2B, that is, a direction of conveyance of the sheet P. To reduce the sliding friction between the stationary member 26 and the fixing belt 25, the stationary member 26 has both ends of the nip formation surface processed into a round shape and a fluororesin layer provided on a surface contacting the fixing belt 25. Although the nip formation surface is configured as a substantially flat surface in the X-direction, the nip formation surface may be slightly curved as long as the sheet P is smoothly conveyed.

Preferably, the stationary member 26 is made of heat-resistant material. This prevents thermal deformation of the stationary member 26 at temperatures in a fixing temperature range desirable to fix the toner image on the sheet P, retains the nip stably, and stabilizes output image quality. The heat-resistant material that configures the stationary member 26 may by, for example, general heat-resistant resin such as polyether sulfone (PES), polyphenylene sulfide (PPS), liquid crystal polymer (LCP), polyether nitrile (PEN), polyamide imide (PAI), and polyether ether ketone (PEEK).

A description is now given of a construction of the tension roller 22. The tension roller 22 is disposed upstream and near the stationary member 26 and is driven to rotate by rotation of the fixing belt 25. A position of the tension roller 22 with respect to the stationary member 26 determines an angle between the fixing belt 25 and the nip formation surface of the stationary member 26 or an angle between the fixing belt 25 entering the nip formation surface and a normal line to the nip formation surface of the stationary member 26 that is an X-direction surface.

With reference to FIGS. 2A and 2B, an angle $\alpha$ is described. The angle $\alpha$ is the angle between the fixing belt 25 entering the nip formation surface and the nip formation surface of the stationary member 26 that is the X-direction surface. As the angle $\alpha$ approaches 180°, the sliding friction at a position at which the fixing belt 25 starts to wind the stationary member 26 decreases.

However, when the tension roller 22 is disposed so that the angle $\alpha$ is 180°, the fixing belt 25 and the conveyance path of the sheet P approach in parallel near an entrance of the nip. The fixing belt 25 may generate some flutter immediately upstream of the nip as the fixing belt 25 passes through the nip.

The flutter may cause the sheet P on which the unfixed toner image T is formed to contact the fixing belt 25 immediately upstream of the nip, which may cause scatter the toner image T. To prevent the toner image T from being scattered, preferably, a position of the tension roller 22 with respect to the stationary member 26 is set so that the angle $\alpha$ between the fixing belt 25 and the nip formation surface of the stationary member 26 is 160° or less when the pressure roller 30 contacts the fixing belt 25.

The pressure adjustment roller 23 is disposed downstream the stationary member 26 and is driven to rotate by rotation of the fixing belt 25. A biasing member 24 presses against the pressure adjustment roller 23 to press the fixing belt 25 outward and applies tension to the fixing belt 25. The biasing member 24 may be, for example, a compression spring.

The fixing roller 21 is disposed upstream the tension roller 22. The fixing roller 21 includes the heater 33 therein, and the heater 33 heats the fixing roller 21 to heat the fixing belt 25. The heater 33 may be configured a halogen heater, a nichrome wire or the like.

A controller may control the heater 33 based on, for example, detection results of a surface temperature of the fixing belt 25 that contacts the fixing roller 21. The fixing roller 21 is driven to rotate by rotation of the fixing belt 25 when the pressure roller 30 contacts the fixing belt 25, but, when the pressure roller 30 separates from the fixing belt 25, the driver coupled to fixing roller 21 independently rotates to rotate the fixing belt 25.

FIG. 2C is a cross-sectional view taken in a dash-dot-dash line 2C-2C of FIG. 2B and viewed from a direction indicated by arrow. The fixing roller 21 has small diameter shaft portions 21*a* smaller than the diameter of the main body portion of the fixing roller 21 at both ends of the fixing roller 21, and skew restraint rings 32 are rotatably inserted into the small diameter shaft portions 21*a*. The outer diameter of the skew restraint ring 32 is substantially the same as the diameter of the main body portion of the fixing roller 21.

The outer surface of the skew restraint ring 32 is a tapered surface 32*a*, and this tapered surface 32*a* makes surface contact with a tapered surface 25*b* formed on the inner surface of a skew prevention guide 25*a* of the fixing belt 25 described later. The heat-resistant material that configures the skew restraint ring 32 may by, for example, general heat-resistant resin such as polyether sulfone (PES), polyphenylene sulfide (PPS), liquid crystal polymer (LCP), polyether nitrile (PEN), polyamide imide (PAI), and polyether ether ketone (PEEK). When a length in the Z-direction between the outer surfaces of the skew restraint rings 32 at both ends is A, the length C of the fixing belt 25 in the Z-direction is longer than the length A, that is, A<C.

The skew prevention guides 25*a* are attached over the entire inner peripheral surface of the fixing belt 25 on both sides of the fixing belt 25 and protrude from the inner peripheral surface of the fixing belt 25. The length in the Z-direction between facing inner surfaces of the skew prevention guides 25*a* at both ends is slightly longer than the length A described above so that the fixing belt 25 can move to left or right in the Z-direction. The inner surfaces of the skew prevention guides 25*a* contact the outer surface of the skew restraint rings 32, and a movement of the fixing belt 25 in the Z direction, that is, a skew of the fixing belt 25 is corrected.

The inner surface of the skew prevention guide 25*a* that is the surface to contact the skew restraint ring 32 is a tapered surface 25*b* to make surface contact with the tapered surface 32*a* of the skew restraint ring 32. Heat-resistant material of the skew prevention guide 25*a* may be, for example, heat-resistant elastic material such as silicone rubber, and fluoro rubber or other materials.

The length B of the stationary member 26 in the Z-direction is shorter by 5 mm at both ends than the length A, that is, A=B+5 mm+5 mm, to avoid interference between the stationary member 26 and the skew prevention guide 25*a* of the fixing belt 25. The inner surface of the fixing belt 25 contacts an entire portion of the length B of the stationary member 26. Lengths of the tension roller 22 and the pressure adjustment roller 23 in the Z-direction are also shorter by 8 mm at both ends than the length A to avoid interference between the skew prevention guide 25*a* of the fixing belt 25 and each of the tension roller 22 and the pressure adjustment roller 23.

A detailed description is now given of a construction of the pressure roller 30. The pressure roller 30 is, for example, a roller constructed of a tubular cored bar made of SUS 304 stainless steel or the like and an elastic layer coating the cored bar with fluoro rubber, silicone rubber, silicone rubber foam, or the like. A heater as a heat source may be disposed inside the tubular cored bar. This prevents the temperature at the nip from falling. The heater may be configured a halogen heater, a nichrome wire, or the like.

The pressure roller 30 is moved in the Y-direction in FIGS. 2A to 2C by a contact-separation mechanism. For example, movement of the pressure roller 30 in the positive Y-direction causes the pressure roller 30 to contact and press against the stationary member 26 via the fixing belt 25 and form the nip. On the other hand, movement of the pressure roller 30 in the minus Y-direction causes the pressure roller 30 to separate from the fixing belt 25.

The driver rotates the pressure roller 30 in a direction indicated by an arrow D2 in FIGS. 2A and 2B. The pressure roller 30 contacts the fixing belt 25 and rotates the fixing belt 25 in a direction indicated by an arrow D3.

Large sliding friction between the fixing belt 25 and the stationary member 26 may stop the rotation of the fixing belt 25 driven by the pressure roller 30, and the pressure roller 30 may slip on the fixing belt 25. To prevent such a situation, oil is applied to the inner surface of the fixing belt 25 to reduce the sliding friction as described later.

The fixing belt 25 is an endless belt having a multilayer structure, such as a two-layered belt including a base and a release layer or a three-layered belt including the base, an elastic layer, and the release layer. Providing the elastic layer on the fixing belt 25 in the three-layer structure causes the surface of the fixing belt 25 to easily adhere to the toner image and improves the image quality.

A detailed description is now given of a construction of an oil applicator 300.

The oil applicator 300 as a lubricant applicator is disposed on the outer peripheral surface of the fixing roller 21. As illustrated in FIG. 2A, the oil applicator 300 includes a felt assembly 301 in which a heat-resistant felt 301*a* as a felt bar is adhered to a felt bracket 301*b*, a bracket 302 having a rotation fulcrum O, and a tension spring 303. The heat-resistant felt 301*a* may be configured as a felt roller.

The felt assembly 301 is detachably fixed to the bracket 302 by a screw 304. An end of the bracket 302 is coupled to a tension spring 303. The tension spring 303 biases the bracket 302 to pivot about a rotation fulcrum O in a clockwise direction. This biasing force causes the heat-resistant felt 301*a* of the felt assembly 301 attached to the bracket 302 to contact and press against the surface of the fixing roller 21.

The heat-resistant felt 301*a* is impregnated with a heat-resistant oil and applies the heat-resistant oil to the surface of the fixing roller 21. In the present embodiment, silicone oil (hereinafter simply referred to as oil) is employed as the heat-resistant oil.

A length D of the heat-resistant felt 301*a* in the Z-direction is equal to or slightly longer than the length A (A≤D). The heat-resistant felt 301*a* does not interfere with the skew prevention guide 25*a* of the fixing belt 25 even when the heat-resistant felt 301*a* is longer than the length A because the heat-resistant felt 301*a* is provided in the axial direction of the fixing roller 21 at a portion in which the fixing belt 25 is not wound around the fixing roller 21.

In the present embodiment, the length D of the heat-resistant felt 301*a* in the Z-direction is longer by 5 mm at both ends of the heat-resistant felt 301*a* than the length A, that is, D=A+5 mm+5 mm. Since the heat-resistant felt 301*a* contacts an entire area of the outer peripheral surface of the fixing roller 21 excluding a small diameter shaft portion 21*a* of the fixing roller 21, the heat-resistant felt 301*a* can uniformly apply oil to the outer peripheral surface of the fixing roller 21 in the Z-direction.

A relation between the length A of the fixing roller 21 in the Z-direction, the length B of the stationary member 26 in the Z-direction, the length C of the fixing belt 25 in the Z-direction, and the length D of the heat-resistant felt 312 in the Z-direction, which are described above, is summarized below. The relation between the length D of the heat-resistant felt 312 in the Z-direction and the length C of the fixing belt 25 in the Z-direction does not matter in the present disclosure because the heat-resistant felt 312 do not directly contact the fixing belt 25. That is, any of C=D, C<D, and C>D may be used as long as the following relation is satisfied.

B<A<C (in the first embodiment, A=B+5 mm+5 mm)

A≤D (in the first embodiment, D=A+5 mm+5 mm)

Transfer of oil by rotation of the fixing belt is described.

The heat-resistant felt 301*a* applies oil to the surface of the fixing roller 21, and the fixing roller 21 transfers and applies the oil to the inner surface of the fixing belt 25 as the fixing belt 25 rotates. The oil stays at both ends of the inner surface of the fixing belt 25, but, as described later, the heat-resistant felt 301*a* corrects the oil through the fixing roller 21.

That is, since the surface of the fixing roller 21 is a rigid body, the heat-resistant felt 301*a* can uniformly contact the surface of the fixing roller 21. Therefore, the heat-resistant felt 301*a* can uniformly apply the oil to the surface of the fixing roller 21.

When the lubricant applicator directly contacts the inner peripheral surface of the fixing belt and applies oil to the inner peripheral surface of the fixing belt, a waving of the fixing belt generated when the fixing belt rotates prevents the lubricant applicator from uniformly applying the oil to the fixing belt. In the embodiment of the present disclosure, the lubricant applicator can uniformly apply oil to the inner surface of the fixing belt 25 even when the fixing belt 25 waves.

FIGS. 2B and 2C illustrate oil accumulation portions in which oil accumulates during rotation of the fixing belt 25. The inner surface of the fixing belt 25 contacts the fixing roller 21, the tension roller 22, the stationary member 26, and the pressure adjustment roller 23, and a small amount of oil exists on their contact surfaces. Especially, the oil existing on the contact surface of the stationary member 26 greatly reduces the sliding friction of the fixing belt 25. Since the fixing belt 25 rotates in the direction indicated by the arrow D3, the oil accumulation portions 401, 402, 403 and 404 are formed at contact start portions at which the fixing belt 25 starts contacting the fixing roller 21, the tension roller 22, the stationary member 26, and the pressure adjustment roller 23.

The oil in the oil accumulation portions 401 to 404 moves to both ends of the fixing belt 25 in the Z-direction in FIG. 2B, and the oil accumulation portion 405 is formed on the inner surface of both ends of the lower portion of the fixing belt 25. The oil on the oil accumulation portion 405 is transferred to the surface of the fixing roller 21 and the surface of the skew restraint rings 32 as the fixing belt 25 rotates and is collected by the heat-resistant felt 301*a* that contacts the fixing roller 21 and the skew restraint rings 32.

In FIGS. 2B and 2C, when the fixing belt 25 stops rotating, the oil in the oil accumulation portions 401 to 404 spreads over the inner surface of the fixing belt 25 and the surface of the tension roller 22, the stationary member 26, and the pressure adjustment roller 23 and moves to both ends of the fixing belt 25 in the Z-direction. In FIG. 2C, the oil moves from the both ends of the tension roller 22, the stationary member 26, and the pressure adjustment roller 23 to both ends of the fixing belt 25, and the oil moves under its own weight to the oil accumulation portion 405 illustrated in FIG. 2C at the lower portion of the fixing belt 25.

When the fixing belt 25 starts rotating again, the heat-resistant felt 301*a* sequentially corrects the oil on the oil accumulation portions 401 to 405 as the fixing belt 25 rotates. Therefore, the amount of oil retained in the oil accumulation portion 405 in the lower portion of the fixing belt 25 is very small. In addition, since the above-described skew prevention guide 25*a* blocks the small amount of oil, the oil does not flow out of the fixing belt 25 even if the amount of oil retained in the oil accumulation portion 405 is large.

Since the lubricant applicator that directly contacts the inner peripheral surface of the fixing belt 25 interferes with the skew prevention guides 25*a* disposed the inner surface of the fixing belt 25 at both ends of the fixing belt 25, it is difficult for such lubricant applicator to provide a lubricant applicator on the entire surface of the fixing belt 25 in the longitudinal direction of the fixing belt 25 and correct the oil accumulated at both ends of the fixing belt. However, the lubricant applicator of the embodiment of the present disclosure can correct the oil on the entire inner surface of the fixing belt 25 in the longitudinal direction of the fixing belt 25 and prevents oil leakage from the end of the fixing belt 25.

The following examples are considered variations of the first embodiment.

(1) Another roller may be added to support the fixing belt 25 in FIG. 2A.

(2) The fixing roller 21 may be moved to the lower right side in FIG. 2A and support the fixing belt 25 without the tension roller 22 that supports the fixing belt 25.

(3) Instead of the fixing roller 21 in FIG. 2C, another roller (for example, the roller 22 or 23) may correct the skew of the fixing belt 25 and perform the application and correction of the oil.

Next, with reference to FIG. 3, a description is given of the fixing device 20 according to a second embodiment.

The second embodiment is different from the above-described first embodiment in that the configuration of an oil applicator 310 disposed on the outer peripheral surface of the fixing roller 21. Other configurations of the second embodiment are similar to those of the first embodiment.

The oil applicator 310 in FIG. 3 includes a compression spring 315, a felt assembly 313 in which a heat-resistant felt 312 as a felt bar is adhered at four places (at 90° intervals) in the circumferential direction on the outer peripheral surface of a switching rotation shaft 311; and a bearing 314 rotatably supporting both ends of the switching rotation shaft 311. The heat-resistant felt 312 may be configured a felt roller.

The switching rotation shaft 311 is disposed between the fixing roller 21 and the supporter 31 and extends in the direction perpendicular to the sheet of FIG. 3, that is, the Z-direction. Bearings 314 of the switching rotation shaft 311 are slidably supported in the Y-direction in FIG. 3.

Compression springs 315 press the bearings 314 and switching rotation shaft 311 against the fixing roller 21, and the heat-resistant felt 312 bonded to the switching rotation shaft 311 is in pressure contact with the surface of the fixing roller 21. The heat-resistant felt 312 is impregnated with oil and applies the oil to the surface of the fixing roller 21.

The fixing roller 21 transfers and applies the oil applied to the surface of the fixing roller 21 to the inner surface of the fixing belt 25 wound around the fixing roller 21. Any extra oil stays at both ends of the inner surface of the fixing belt 25, but both ends of the heat-resistant felt 301*a* correct the extra oil through the fixing roller 21.

The fixing device 20 includes a lever with a four-position lock. The lever is disposed at front end of the felt assembly 313, that is, one end in the Z-direction of the felt assembly 313 in FIG. 3 and allows the felt assembly 313 to rotate and fix the position of the felt assembly 313 every 90°. The oil in the heat-resistant felt 312 decreases with use time because the oil volatilizes slightly at high temperature. Therefore, the felt assembly 313 has a life and needs replacement after a predetermined use time.

In the first embodiment, replacing the felt assembly needs detachment and attachment of the fixing belt 25, which results in an issue that replacing the felt assembly takes much time. The second embodiment solves the issue in the first embodiment because the felt assembly 313 includes four heat-resistant felts 312 in the circumferential direction, and an easy operation of the lever switches the heat-resistant felt 312 to new one. Note that a number of heat-resistant felts 312 attached to the switching rotation shaft 311 may be two or three, or five or more.

Next, with reference to FIGS. 4A and 4B, a description is given of the fixing device 20 according to the third embodiment. As illustrated in FIG. 4A, the fixing belt 25 is stretched by three rollers, that is, the fixing roller 21, the stationary member 26, and the pressure adjustment roller 23. That is, the tension roller 22 used in the first embodiment and the second embodiment is omitted in the third embodiment.

The fixing device 20 includes a steering mechanism that moves left and right an axial end portion of the fixing roller 21 at front side of the paper surface of FIG. 4A. An operation of the steering mechanism can adjust a position of the fixing belt 25 in the Z-direction.

The fixing device 20 includes position detection sensors disposed near both ends of the fixing belt 25, and a steering operation of the steering mechanism adjusts the position of the fixing belt 25 based on output values from the position detection sensors. Therefore, the fixing device 20 in the third embodiment does not include the skew prevention guides 25*a* and the skew restraint ring 32 in the first embodiment illustrated in FIG. 2C.

In FIG. 4B, assuming that the oil is applied to the surface of the fixing roller 21 for a length A in the Z-direction, and an width of the fixing belt 25 that is the length of the fixing belt 25 in the Z-direction is C, C is set smaller than A, that is, $C<A$, because the above-described steering operation moves the fixing belt 25 right and left in the Z-direction. Therefore, the length relation of parts in the Z-direction is $B<C<A\leq D$. Although the steering operation moves the fixing belt 25 right and left, the end of the fixing belt 25 is on the surface of the fixing roller 21.

Similar to the first embodiment and the second embodiment, the frame of the fixing device 20 supports the supporter 31 to support and fix the stationary member 26. If the stationary member 26 to support the fixing belt 25 is exposed when the above-described steering operation moves the fixing belt 25 slightly left and right in the Z-direction, the sheet P and the toner image T contact the stationary member 26, and a printing failure may occur. Therefore, the length B of the stationary member 26 in a Z-direction is shorter than a length C of the fixing belt 25 in the Z-direction, that is, $B<C$.

The length B of the stationary member 26 is shorter by 8 mm at both ends than the length A of the fixing roller 21, that is, A=B+8 mm+8 mm. The steering operation adjusts positions of both ends of the fixing belt 25 within the ranges of 8 mm on both ends of the fixing roller 21. Lengths of the pressure adjustment roller 23 in the Z-direction in FIG. 4A is also shorter by 8 mm at both ends than the length A of the fixing roller 21 so that the fixing belt 25 covers the pressure adjustment roller 23.

Similar to the first embodiment, the length D of the heat-resistant felt 301*a* in the Z-direction is set longer than the length A of the fixing roller 21. In the third embodiment, the length D of the heat-resistant felt 301*a* in the Z-direction is set longer by 5 mm at both ends of the heat-resistant felt 301*a* than the length A of the fixing roller 21, that is, D=A+5 mm+5 mm.

FIGS. 4A and 4B illustrate oil accumulation portions 401, 403, and 404 in which oil accumulates during rotation of the fixing belt 25. The inner surface of the fixing belt 25 contacts the fixing roller 21, the stationary member 26, and the pressure adjustment roller 23, and a small amount of oil exists on their contact surfaces. The stationary member 26 contacts the fixing belt 25 with higher contact pressure than the fixing roller 21 and the pressure adjustment roller 23. The oil existing on the contact surface of the stationary member 26 greatly reduces the sliding friction of the fixing belt 25.

Since the fixing belt 25 rotates in the direction indicated by the arrow D3, the oil accumulation portions 401, 403, and 404 are formed at contact start portions at which the fixing belt 25 starts contacting the fixing roller 21, the stationary member 26, and the pressure adjustment roller 23.

Some of the oil in the oil accumulation portions 401, 403, and 404 moves to both ends of the fixing belt 25 in the Z-direction, and rotations of the fixing belt 25 brings the oil from the oil accumulation portions 401, 403, and 404 to the oil accumulation portion 405 in the lower portion of the fixing belt 25. The rotations of the fixing belt 25 raise the oil on the oil accumulation portion 405 to both ends of the surface of the fixing roller 21, and both ends of the heat-resistant felt 301*a* correct the oil.

Specifically, the rotations of the fixing belt 25 raise some of the oil from the oil accumulation portion 403 in the lower portion of the fixing belt 25 to the upper oil accumulation portion 401, and the oil in the oil accumulation portion 401 moves to both ends in the Z-direction and is pushed out to the shoulder portion 21*b* of the surface of the fixing roller 21. The oil pushed out to the shoulder portion 21*b* of the fixing roller 21 contacts the both ends of the heat-resistant felt 301*a* with the rotations of the fixing roller 21 and is collected at the both ends of the heat-resistant felt 301*a*.

In FIG. 4A of the third embodiment, when the fixing belt 25 stops rotating, the oil in the oil accumulation portions 401, 403, and 404 spreads on the inner surface of the fixing belt 25 and the surface of the pressure adjustment roller 23 and the stationary member 26, and some of the oil move to both ends of the fixing belt 25 in the Z-direction. In FIG. 4A, the oil moves from the both ends of the pressure adjustment roller and the stationary member 26 to both ends of the fixing belt 25, and a weight of the oil moves the oil to the oil accumulation portion 405 at the lower portion of the fixing belt 25.

When the fixing belt 25 starts rotating again, the fixing belt 25 carries the oil on the oil accumulation portion 405, and the heat-resistant felt 301*a* corrects the oil. Therefore, the amount of oil retained in the oil accumulation portion 405 in the lower portion of the fixing belt 25 is very small. Oil does not flow out of the end of the fixing belt 25.

The present disclosure is not limited to the details of the embodiments described above, and various modifications and improvements are possible. For example, although the skew restraint rings 32 that are the skew restraint members in the first embodiment are rotatably fitted to the small diameter shaft portions 21*a* formed at both ends of the fixing roller 21 as illustrated in FIG. 2C, the skew restraint rings 32 or the skew restraint members may be rotatably fitted to small diameter shaft portions formed on the tension roller 22 or the pressure adjustment roller 23 other than the fixing roller 21.

Instead of the fixing roller 21 incorporating the heater 33, a tension roller not including the heater may be used, and a planar heat generator as the heater may be disposed on the nip formation surface of the stationary member 26.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A fixing device comprising:

a stationary member;

a fixing roller including a heater configured to heat the fixing roller;

an endless belt stretched over the stationary member and the fixing roller;

a pressure rotator disposed opposite the stationary member via the endless belt to form a fixing nip between the pressure rotator and the endless belt on the stationary member; and a lubricant applicator comprising:

a switching rotation shaft; and a felt assembly coupled to the switching rotation shaft and including a plurality of discrete heat resistant felts disposed at intervals in a circumferential direction of the felt assembly and configured to uniformly apply a lubricant to the fixing roller, wherein each of the discrete heat resistant felts is configured, based on a stepwise locked rotation of the felt assembly, to contact the fixing roller over an entire length of the fixing roller in an axial direction of the fixing roller, the fixing roller contacting an inner surface of the endless belt and having an axial length equal to or greater than an axial length of the stationary member, wherein the switching rotation shaft is stepwise lock rotatable in a predetermined arc range to replace one of the discrete heat resistant felts with another of the discrete heat resistant felts.

2. The fixing device according to claim 1, further comprising:

skew prevention guides disposed on an inner surface of the endless belt and at both ends of the endless belt in a width direction of the endless belt; and skew restraint members that contact the skew prevention guides to correct skew of the endless belt.

3. The fixing device according to claim 2, wherein the fixing roller has, at both ends in the axial direction, small diameter shaft portions each having a smaller diameter than a body of the fixing roller, wherein the skew restraint members are rings rotatably fitted to the small diameter shaft portions.

4. The fixing device according to claim 1, wherein each of the discrete heat resistant felts comprises a felt bar impregnated with the lubricant and fixed to contact the fixing roller.

5. The fixing device according to claim 1, wherein:

the discrete heat resistant felts comprise four heat resistant felts disposed at ninety-degree intervals in the circumferential direction of the felt assembly.

6. An image forming apparatus comprising the fixing device according to claim 1.

7. The fixing device according to claim 1, wherein:

each of the discrete heat resistant felts comprises a felt roller impregnated with the lubricant and fixed to contact the fixing roller.

8. The fixing device according to claim 1, wherein the lubricant applicator comprises:

bearings rotatably supporting each end of the switching rotation shaft; and compression springs each configured to apply pressure to one of the bearings to move one of the discrete heat resistant felts into contact with the fixing roller.

9. The fixing device according to claim 1, wherein an angle $\alpha$ between the endless belt and a nip formation surface of the stationary member is 160 degrees or less when the pressure rotator contacts the endless belt.

* * * * *